US011542798B2

(12) United States Patent
Brown

(10) Patent No.: US 11,542,798 B2
(45) Date of Patent: Jan. 3, 2023

(54) VARIABLE ORIFICE VALVE FOR GAS LIFT MANDREL

(71) Applicant: Baker Hughes Oilfield Operations LLC, Houston, TX (US)

(72) Inventor: Donavan Brown, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/170,832

(22) Filed: Feb. 8, 2021

(65) Prior Publication Data

US 2022/0251932 A1 Aug. 11, 2022

(51) Int. Cl.
*E21B 34/08* (2006.01)
*E21B 43/12* (2006.01)

(52) U.S. Cl.
CPC ..... *E21B 43/123* (2013.01); *E21B 34/08* (2013.01)

(58) Field of Classification Search
CPC ..... E21B 34/066; E21B 34/08; E21B 43/123
See application file for complete search history.

(56) References Cited

U.S. PATENT DOCUMENTS 2,649,272 A * 8/1953 Barbato ..... F16K 3/03 138/45
3,646,953 A 3/1972 Elliott et al.
3,874,445 A 4/1975 Terral
3,888,273 A * 6/1975 Douglas ..... E21B 43/123 417/115
4,295,795 A 10/1981 Gass et al.
4,505,331 A 3/1985 Akkerman
RE32,441 E 6/1987 Higgins et al.
4,685,523 A 8/1987 Paschal et al.
5,176,164 A * 1/1993 Boyle ..... E21B 34/06 137/155
5,535,767 A 7/1996 Schnatzmeyer et al.
5,971,004 A 10/1999 Pringle
(Continued)

FOREIGN PATENT DOCUMENTS

EP 2666957 A2 11/2013
WO 2001095696 A1 12/2001
(Continued)

OTHER PUBLICATIONS

"MMRG Series Side Pocket Mandrels", Schlumberger, MMRG Series Side Pocket Mandrels, Sales Brochure, 2015.
Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.
(Continued)

*Primary Examiner* — Matthew R Buck
(74) *Attorney, Agent, or Firm* — Crowe & Dunlevy, P.C.

(57) ABSTRACT

A gas lift module is designed for deployment within a tubing string in a well that has an annular space surrounding the gas lift module and tubing string. A gas lift valve within the gas lift module includes a valve seat, a valve stem configured to abut the valve seat when the gas lift valve is closed, and a variable orifice valve assembly. The variable orifice valve assembly has an orifice chamber, a variable orifice within the orifice chamber, and a retaining sleeve within the orifice chamber. The variable orifice includes a plurality of interconnected plates that are configured to expand or contract together to form a central aperture of varying size and an orifice spring. The retaining sleeve captures the variable orifice in a contracted state when the retaining sleeve is in contact with the variable orifice.

17 Claims, 3 Drawing Sheets

(56) References Cited

U.S. PATENT DOCUMENTS

| | | | | |
|---|---|---|---|---|
| 6,070,608 | A * | 6/2000 | Pringle | E21B 34/066 137/155 |
| 6,148,843 | A * | 11/2000 | Pringle | E21B 43/123 137/155 |
| 6,206,645 | B1 | 3/2001 | Pringle | |
| 6,375,155 | B1 * | 4/2002 | Janssens | F16L 55/10 251/212 |
| 6,679,332 | B2 * | 1/2004 | Vinegar | H04B 13/02 166/373 |
| 7,213,607 | B2 | 5/2007 | De | |
| 9,057,243 | B2 * | 6/2015 | Hendel | E21B 21/10 |
| 9,453,397 | B2 | 9/2016 | Dowling et al. | |
| 9,453,398 | B1 * | 9/2016 | Zhang | E21B 43/123 |
| 10,655,439 | B2 * | 5/2020 | Murdoch | E21B 43/123 |
| 10,677,028 | B2 | 6/2020 | Oliphant | |
| 10,787,889 | B2 | 9/2020 | Salihbegovic et al. | |
| 2001/0017157 | A1 | 8/2001 | Pringle | |
| 2002/0020533 | A1 | 2/2002 | Tubel | |
| 2007/0181312 | A1 | 8/2007 | Kritzler et al. | |
| 2013/0146155 | A1 | 6/2013 | Gilbertson et al. | |
| 2013/0220599 | A1 | 8/2013 | Rae | |
| 2020/0032592 | A1 | 1/2020 | Romer et al. | |

FOREIGN PATENT DOCUMENTS

| | | | |
|---|---|---|---|
| WO | 2014022121 | A1 | 2/2014 |
| WO | 2016049726 | A1 | 4/2016 |

OTHER PUBLICATIONS

Schlumberger, "Side Pocket Mandrels—Reliable Gas Lift with Flexibility for the Future; 17-AL-291763", Jan. 1, 2017.

Schlumberger, "S02-30R-B Dual-Check Shear Orifice Gas Lift Valve", Schlumberger; SO2-30R-B Dual-Check Shear Orifice Gas Lift Valve; 2011, Jan. 1, 2011.

Schlumberger, "WRFC-H Wireline-retrievable flow control valve for gas lift applications", Schlumberger; WRFC-H Product Brochure; 09-CO-0263; 2010, Jan. 1, 2010.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

Korea Intellectual Property Office (ISA/KR); Search Report and Written Opinion; PCT/US2022/070505; dated Apr. 20, 2022.

* cited by examiner

VARIABLE ORIFICE VALVE FOR GAS LIFT MANDREL

FIELD OF THE INVENTION

This invention relates generally to the field of oil and gas production, and more particularly to a gas lift system that incorporates an improved gas lift module.

BACKGROUND

Gas lift is a technique in which gaseous fluids are injected into the tubing string from the surrounding annulus to reduce the density of the produced fluids to allow the formation pressure to push the less dense mixture to the surface. The gaseous fluids can be injected into the annulus from the surface. A series of gas lift valves allow access from the annulus into the production tubing. The gas lift valves can be configured to automatically open when the pressure gradient between the annulus and the production tubing exceeds the closing force holding each gas lift valve in a closed position. In most installations, each of the gas lift mandrels within the gas lift system is deployed above a packer or other zone isolation device to ensure that liquids and wellbore fluids do not interfere with the operation of the gas lift valve. Increasing the pressure in the annular space above the packer will force the gas lift valves to open at a threshold pressure, thereby injecting pressured gases into the production tubing.

To permit the unimpeded production of wellbore fluids through the production tubing, the gas lift valves are housed within "side pocket mandrels" that include a valve pocket that is laterally offset from the production tubing. Because the gas lift valves are contained in these laterally offset valve pockets, tools can be deployed and retrieved through the open primary passage of the side pocket mandrel. The predetermined position of the gas lift valves within the production tubing string controls the entry points for gas into the production string.

A common problem in gas lift completions is the management of interventions required to accommodate unforeseen well operations or changes in the volume or rate of injection gas needed to improve production with the gas lift system. For example, while setting packers and testing tubing by increasing the pressure within the annulus, "dummy" valves are typically installed within the side pocket mandrels to prevent flow of completion fluids from the annulus into the production tubing. Once the packers have been set, the dummy valves are replaced with conventional gas lift valves that permit flow into the production string from the annulus.

As production declines or the well experiences significant liquid loading problems, a higher volume of injection gas may be needed to meet production goals. In the past, new higher-volume gas lift valves would need to be installed to accommodate the larger volumes of injection gas. The removal and installation of gas lift valves is expensive and time consuming, which can result in costly production delays. There is, therefore, a need for an improved gas lift system that overcomes these and other deficiencies in the prior art.

SUMMARY OF THE INVENTION

In one aspect, embodiments disclosed herein include a gas lift valve for use within a gas lift module that is deployed within a tubing string in a well that has an annular space surrounding the gas lift module and tubing string. The gas lift valve includes a valve seat, a valve stem configured to abut the valve seat when the gas lift valve is closed, and a variable orifice valve assembly. The variable orifice valve assembly has an orifice chamber, a variable orifice within the orifice chamber, and a retaining sleeve within the orifice chamber. The variable orifice includes a plurality of interconnected plates that are configured to expand or contract together to form a central aperture of varying size and an orifice spring. The retaining sleeve captures the variable orifice in a contracted state when the retaining sleeve is in contact with the variable orifice.

In another aspect, embodiments disclosed herein include a variable orifice valve assembly for use in a gas lift valve designed for use within a gas lift module. The variable orifice valve assembly comprising a variable orifice that includes an aperture that expands from a first size to a second size.

In yet another aspect, embodiments disclosed herein include a gas lift valve for use within a gas lift module deployed within a tubing string in a well that has an annular space surrounding the gas lift module and tubing string. The gas lift valve has a variable orifice valve assembly. The variable orifice valve assembly includes an orifice chamber and a variable orifice within the orifice chamber. The variable orifice includes an aperture that expands from a first size to a second size.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells.

Figure 1:
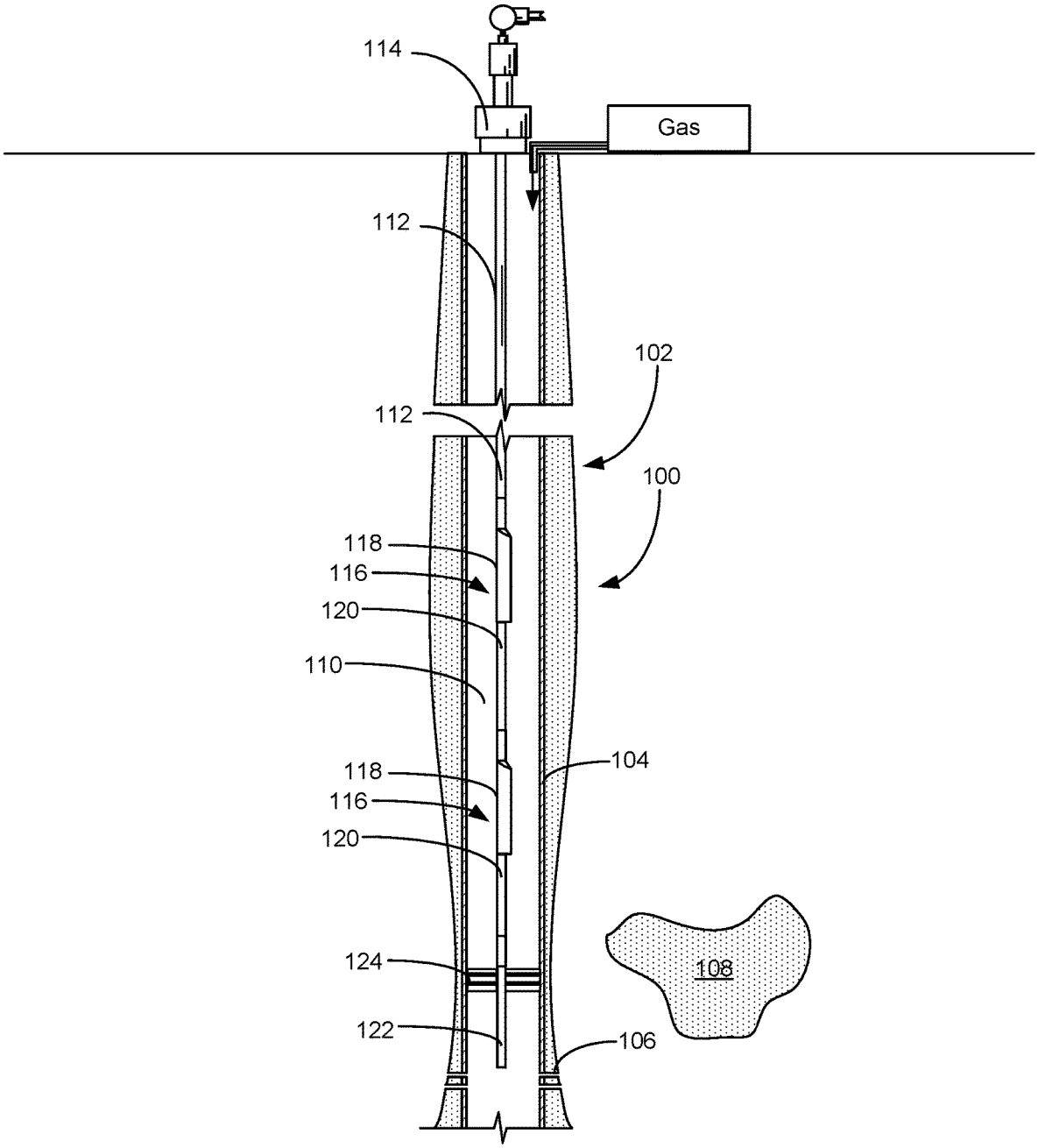
FIG. 1 is a side view of a gas lift system deployed in a conventional well.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annular space or "annulus" 110 is formed between the gas lift system 100 and the casing 104. The gas lift system 100 is connected to production tubing 112 that conveys produced wellbore fluids from the formation 108, through the gas lift system 100, to a wellhead 114 on the surface.

The gas lift system 100 includes one or more gas lift modules 116. The gas lift modules 116 each include a side pocket mandrel 118, which may be connected to a pup joint 120. An inlet pipe 122 extends through one or more packers 124 into a lower zone of the well 102 closer to the perforations 106. In this way, produced fluids are carried through the inlet pipe 122 into the lowermost (upstream) gas lift module 116. The produced fluids are carried through the gas lift system 100 and the production tubing 112, which conveys the produced fluids through the wellhead 114 to surface-based storage or processing facilities.

In accordance with well-established gas lift principles, pressurized fluids or gases are injected from the surface into the annulus 110 surrounding the gas lift system 100. When the pressure gradient between the annulus 110 and the production tubing 112 exceeds a threshold value, the gas lift modules 116 admit the pressurized gases into the production tubing 112 through the side pocket mandrel 118. The pressurized gases combine with the produced fluids in the gas lift modules 116 to reduce the overall density of the fluid, which facilitates the recovery of the produced fluids from the well 102. The gas lift system 100 may find utility in recovering liquid and multiphase hydrocarbons, as well as in unloading water-based fluids from the well 102.

Figure 2:
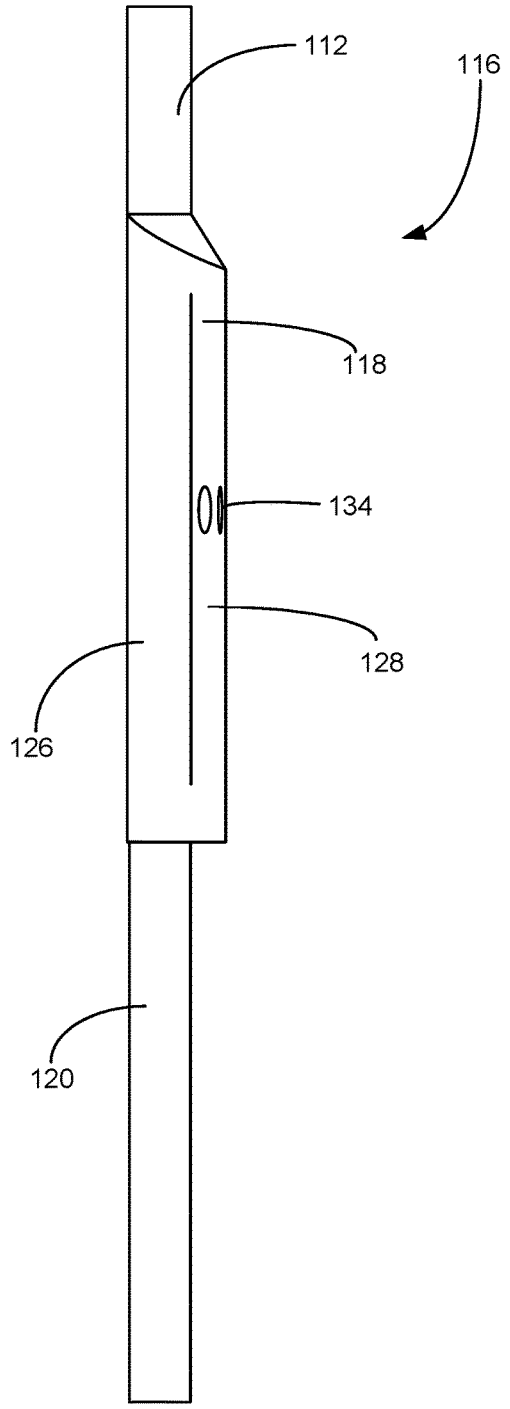
FIG. 2 is a side view of a side pocket mandrel constructed in accordance with an embodiment of the invention.
Figure 3:
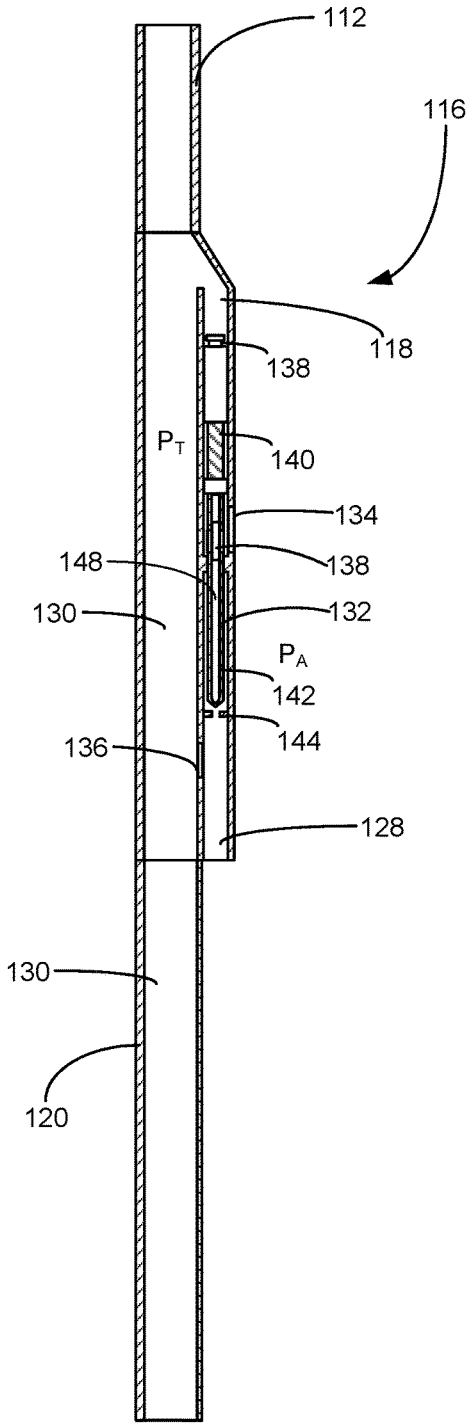
FIG. 3 is a side cross-sectional view of the side pocket mandrel.

Turning to FIGS. 2-3, shown therein are side and cross-sectional views, respectively, of the gas lift module 116. As best illustrated in the cross-sectional view in FIG. 3, the side pocket mandrel 118 includes a central body 126 and a gas lift valve pocket 128 within the side pocket mandrel 118. The central body 126 includes a central bore 130. The gas lift valve pocket 128 is laterally offset and separated from the central bore 130. The side pocket mandrel 118 includes a retrievable gas lift valve 132 within the gas lift valve pocket 128.

The gas lift valve 132 controls the passage of fluids from the annulus 110 through an external port 134 in response to pressure in the annulus 110 that exceeds the threshold opening pressure for the gas lift valve 132. When the gas lift valve 132 opens, fluid from the annulus 110 is admitted through the external port 134 into the side pocket mandrel 118. The pressurized fluid is directed from the gas lift valve pocket 128 into the central bore 130 through an internal port 136, where it joins fluids produced from the perforations 106. In this way, the pressure in the central bore 130 ($P_T$) is lower than the pressure in the annulus 110 ($P_A$) when the gas lift valve 132 opens.

The gas lift valve 132 includes a latch mechanism 138 that holds the gas lift valve 132 within the gas lift valve pocket 128, and facilitates removal of the gas lift valve 132 with external wireline tools. The gas lift valve 132 also includes a valve spring 140 that biases the gas lift valve 132 in a closed position such that a valve stem 142 rests on a valve seat 144 (shown in FIG. 3). When the annular pressure (PA) applied to the gas lift valve 132 overcomes the closing force applied by the valve spring 140, the gas lift valve 132 compresses the valve spring 140 and the valve stem 142 lifts off the valve seat 144 to permit flow through the valve seat 144.

Figure 4:
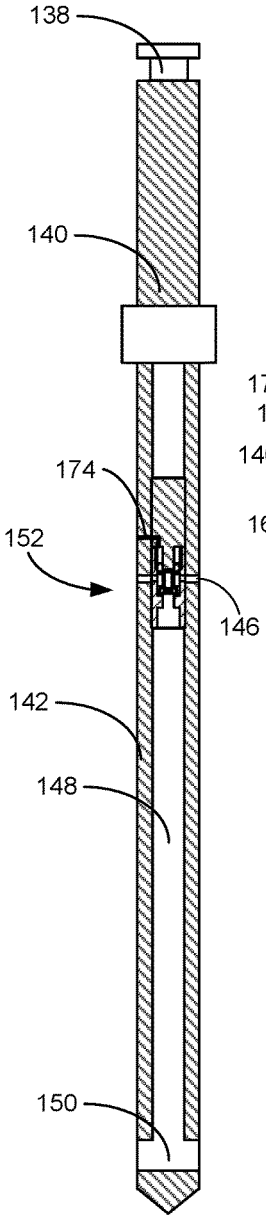
FIG. 4 is a cross-sectional view of the gas lift valve.

Turning to FIG. 4, shown therein is a cross-sectional depiction of the gas lift valve 132. The gas lift valve 132 includes inlet ports 146, a central channel 148 and one or more outlet ports 150. Generally, injection gas flows from the annulus 110 through the external port 134 into the gas lift valve 132 through the inlet ports 146. The gas passes through the central channel 148 and is discharged through outlet ports 150, before entering the central bore 130 through the internal port 136.

Unlike prior art gas lift modules, the gas lift valve 132 also includes a variable orifice valve assembly 152 that can be used to adjust the flow rate of gas through the gas lift valve 132. Generally, the variable valve assembly 152 can be enlarged from a first orifice size to a second orifice size to increase the flow of gas through the gas lift valve 132. Using a smaller orifice size permits enhanced control of the gas lift operation using smaller quantities of gas, while using a larger orifice size permits the increased flow of gas through the gas lift valve 132 when appropriate. Importantly, the variable orifice valve assembly 152 can be actuated while installed within the gas lift module 116 in the well 102, which obviates the need to remove the gas lift valve 132 and install a new gas lift valve 132 with a larger orifice.

Figure 5:
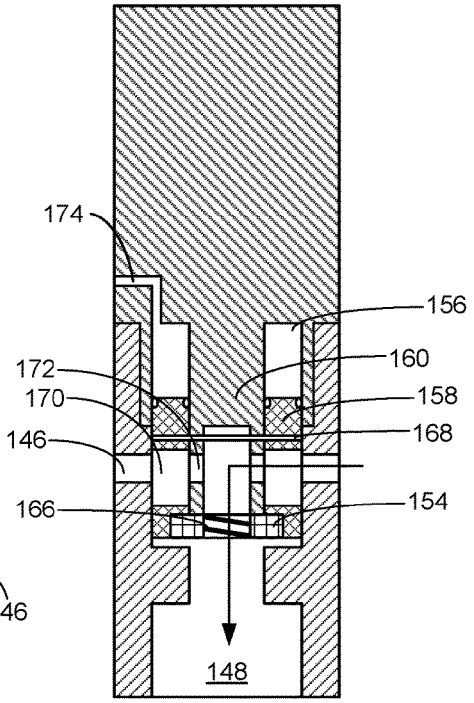
FIG. 5 is a cross-sectional view of a portion of the gas lift valve showing the variable orifice valve assembly in a first state.

As depicted in the close-up cross-sectional view in FIG. 5, the variable orifice valve assembly 152 includes a variable orifice 154, an orifice chamber 156, a retaining sleeve 158, and standoff 160. The retaining sleeve 158 and standoff 160 include fluid passages 170, 172, respectively, that align with the inlet ports 146 of the gas lift valve 132 to communicate gas through the orifice chamber 156 and variable orifice 154 into the central channel 148. The retaining sleeve 158 encircles the standoff 160 such that the standoff 160 is captured within the center of the hollow cylindrical form of the retaining sleeve 158. The standoff 160 is stationary and includes a distal end proximate the variable orifice 154 and a proximal end opposite the distal end.

The variable orifice 154 is generally configured as a cylinder that includes a plurality of plates 162 that are interconnected in a manner that forms a smaller aperture 164 (FIG. 7) when the plates 162 are contracted in a more-overlapped manner, and a larger aperture 162 (FIG. 8) when the plates 162 are radially expanded in a less-overlapped manner. An orifice spring 166 within the variable orifice 154 applies an outward force against the plates 162 to urge the plates 162 into the less-overlapped state that forms a larger aperture 164. The plates 162 can be interconnected with pins and guide slots that control the radial expansion and contraction of the plates 162.

Figure 6:
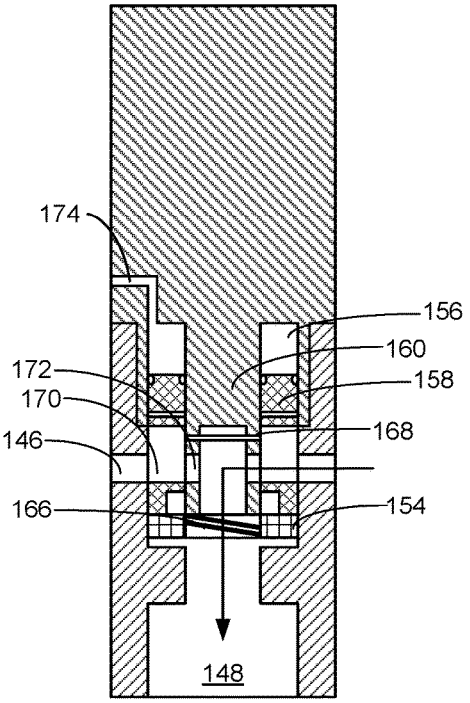
FIG. 6 is a cross-sectional view of a portion of the gas lift valve showing the variable orifice valve assembly in a second state.
Figure 7:
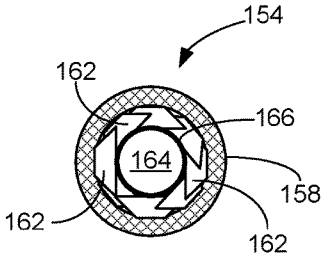
FIG. 7 is a plan view of the variable orifice assembly in a first state.
Figure 8:
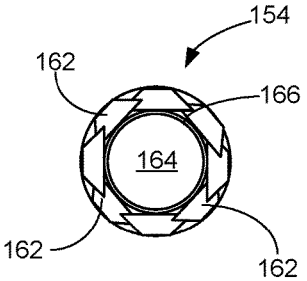
FIG. 8 is a plan view of the variable orifice assembly in a second state.

The retaining sleeve 158 opposes the radial expansion of the plates 162 and prevents the variable orifice 154 from expanding (FIGS. 5 and 7). Once the retaining sleeve 158 is removed from the variable orifice 154 (FIGS. 6 and 8), the force applied by the orifice spring 166 is no longer opposed and the plates 162 radially expand to form the larger aperture 164. The orifice spring 166 can include one or more compressible c-clips, spiraled springs, or any other spring that can exert a force in an outward radial direction.

As illustrated in FIG. 5, the retaining sleeve 158 is held in place within the orifice chamber 156 by a shear pin 168. The shear pin 168 extends through the retaining sleeve 158 and the stationary standoff 160. The shear pin 168 is designed to fracture under a specified load. When the shear pin 168 fractures, the retaining sleeve 158 is permitted to move along the standoff 160 toward the proximal end of the standoff 160, while the variable orifice 154 remains in stationary abutment with the distal end of the standoff 160. In this way, as the retaining sleeve 158 is moved proximally along the standoff 160, the standoff 160 pushes the variable orifice 154 out of association with the retaining sleeve 158

(as depicted in FIG. 6), thereby freeing the variable orifice 154 from the compressive force applied by the retaining sleeve 158.

The shearing load can be applied to the retaining sleeve 158 in a variety of ways. In one embodiment, the retaining sleeve 158 is moved within the orifice chamber 156 by creating a sufficient pressure differential across the retaining sleeve 158. A first (distal) side of the retaining sleeve 158 is exposed to annular pressure ($P_A$), while a second (proximal) side of the retaining sleeve is exposed to tubing pressure ($P_T$) through an equalization port 174 that extends from the variable orifice valve assembly 152 to the central bore 130. Increasing the annular pressure ($P_A$) to a threshold extent creates a suitable gradient across the retaining sleeve 158 to break the shear pin 168 and force the retaining sleeve 158 to slide over the standoff 160 and disengage from the variable orifice 154. In this way, the retaining sleeve 158 functions as a piston that can be forced to slide along the standoff 160 to release the variable orifice 154. In another embodiment, a battery-powered electric actuator can be used to push the retaining sleeve 158 away from the variable orifice 154 in response to a command signal.

In exemplary embodiments, the variable orifice valve assembly 152 is installed within the gas lift valve 132, which is in turn installed within the side pocket mandrel 118 before the gas lift module 116 is deployed within the well 102. The variable orifice 154 is initially compressed by the retaining sleeve 158, which is held in place by the shear pin 168. In this initial state, the aperture 164 of the variable orifice 154 is a first size that is designed to provide optimized operation of the gas lift system 100 under low gas flow conditions. Once the conditions within the well 102 change and the variable orifice 154 is no longer permitting optimal operation of the gas lift system 100, the variable orifice 154 can be actuated such that the aperture 164 expands to a second size that is larger than the first size. The variable orifice 154 can be expanded by disconnecting the retaining sleeve 158 from the variable orifice 154. In some embodiments, the retaining sleeve 158 is moved away from the variable orifice 154 by increasing the annular pressure ($P_A$) to an extent that the pressure gradient formed across the retaining sleeve 158 ruptures the shear pin 168. In other embodiments, a remotely controlled actuator can be used to push the retaining sleeve 158 off the variable orifice 154.

Thus, exemplary embodiments include a gas lift module 116 for use within a gas lift system 100 that includes a gas lift valve 132 with a variable orifice valve assembly 152. The variable orifice valve assembly 152 includes a variable orifice 154 that can be enlarged without retrieving the gas lift valve 132 from the gas lift module 116. This overcomes a number of inefficiencies in the prior art that require expensive and disruptive interventions to exchange gas lift valves to accommodate changing wellbore conditions.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A gas lift valve for use within a gas lift module deployed within a tubing string in a well that has an annular space surrounding the gas lift module and tubing string, the gas lift valve comprising:

a valve seat;

a valve stem configured to abut the valve seat when the gas lift valve is closed; and a variable orifice valve assembly, wherein the variable orifice valve assembly comprises:

an orifice chamber;

a variable orifice within the orifice chamber, wherein the variable orifice comprises:

a plurality of interconnected plates that are configured to expand or contract together to form a central aperture of varying size; and an orifice spring; and a retaining sleeve within the orifice chamber, wherein the retaining sleeve captures the variable orifice in a contracted state when the retaining sleeve is in contact with the variable orifice.

2. The gas lift valve of claim 1, wherein the variable orifice valve assembly further includes a standoff that includes a proximal end and a distal end.

3. The gas lift valve of claim 2, wherein the retaining sleeve is cylindrical and surrounds the standoff.

4. The gas lift valve of claim 2, wherein the standoff is configured to disassociate the variable orifice from the retaining sleeve by preventing the variable orifice from moving while the retaining sleeve is urged toward the proximal end of the standoff.

5. The gas lift valve of claim 1, wherein the orifice spring is inside the central aperture of the variable orifice.

6. The gas lift valve of claim 4, wherein the orifice spring is a metal c-clip that exerts a force on the plurality of interconnected plates in an outward radial direction.

7. The gas lift valve of claim 4, wherein the orifice spring is a spiral spring that exerts a force on the plurality of interconnected plates in an outward radial direction.

8. The gas lift valve of claim 2, wherein the variable orifice valve assembly further comprises a shear pin that extends through the retaining sleeve and standoff to temporarily maintain the retaining sleeve in a fixed position about the standoff.

9. The gas lift valve of claim 8, wherein the shear pin is configured to be fractured by a pressure gradient applied across the retaining sleeve.

10. The gas lift valve of claim 8, wherein the variable orifice valve assembly includes an equalization port that communicates pressure from inside the tubing string to a proximal side of the retaining sleeve.

11. A variable orifice valve assembly for use in a gas lift valve designed for use within a gas lift module, wherein the variable orifice valve assembly comprises a variable orifice that includes an aperture that expands from a first size to a second size, wherein the variable orifice comprises a plurality of interconnected plates that together form the aperture, wherein the plurality of interconnected plates are configured to expand together to change the aperture from the first size to the second size, and wherein the variable orifice further comprises an orifice spring that exerts a force in a radial direction to urge the plurality of interconnected plates to radially expand to change the aperture to the second size.

12. The variable orifice valve assembly of claim 11, wherein the orifice spring is inside the aperture of the variable orifice.

13. The variable orifice valve assembly of claim 12 further comprising a retractable retaining sleeve that captures the variable orifice in a contracted state when the retaining sleeve is in contact with the variable orifice.

14. The variable orifice valve assembly of claim 13, wherein the retaining sleeve is configured to be retracted from the variable orifice in response to a sufficient pressure gradient applied across the retaining sleeve.

15. A gas lift valve for use within a gas lift module deployed within a tubing string in a well that has an annular space surrounding the gas lift module and tubing string, the gas lift valve comprising:

a variable orifice valve assembly, wherein the variable orifice valve assembly comprises:

an orifice chamber; and a variable orifice within the orifice chamber, wherein the variable orifice includes a plurality of interconnected plates that together form an aperture and wherein the plurality of interconnected plates are configured to expand together to change the aperture from a first size to a second size.

16. The gas lift valve of claim 15, wherein the variable orifice further comprises an orifice spring that exerts a force in a radial direction to urge the plurality of interconnected plates to radially expand to change the aperture to the second size.

17. The gas lift valve of claim 16 further comprising a retractable retaining sleeve that captures the variable orifice in a contracted state when the retaining sleeve is in contact with the variable orifice.

* * * * *